United States Patent [19]

Meier

[11] 4,216,817

[45] Aug. 12, 1980

[54] INDUCTOR FOR AN ELECTROMAGNETIC MOLD FOR CONTINUOUS CASTING

[75] Inventor: Hans-Anton Meier, Sierre, Switzerland

[73] Assignee: Swiss Aluminium Ltd., Chippis, Switzerland

[21] Appl. No.: 964,616

[22] Filed: Nov. 29, 1978

[30] Foreign Application Priority Data

Dec. 5, 1977 [CH] Switzerland ..... 14820/77

[51] Int. Cl.[3] ..... B22D 27/02

[52] U.S. Cl. ..... 164/147; 219/10.79

[58] Field of Search ..... 164/48, 49, 146, 147, 164/250, 251; 219/10.79, 10.75, 10.77

[56] References Cited

U.S. PATENT DOCUMENTS 3,702,155 11/1972 Getselev ..... 164/250

*Primary Examiner*—Robert D. Baldwin
*Assistant Examiner*—K. Y. Lin
*Attorney, Agent, or Firm*—Bachman and LaPointe

[57] ABSTRACT

An inductor for an electromagnetic mold used for example for continuous casting of long format rolling ingots has a metallic loop with a hollow space in it to convey a coolant. The vertical dimension at the middle of the sidewall ($H_1$) of the loop is a multiple of the vertical dimension ($H_2$) at the corners of the loop. Such a device compensates for the shrinkage which occurs at the sidewall of the ingot and yields ingots which do not suffer from the concavity which would otherwise occur there.

10 Claims, 9 Drawing Figures

INDUCTOR FOR AN ELECTROMAGNETIC MOLD FOR CONTINUOUS CASTING

Figure 1:
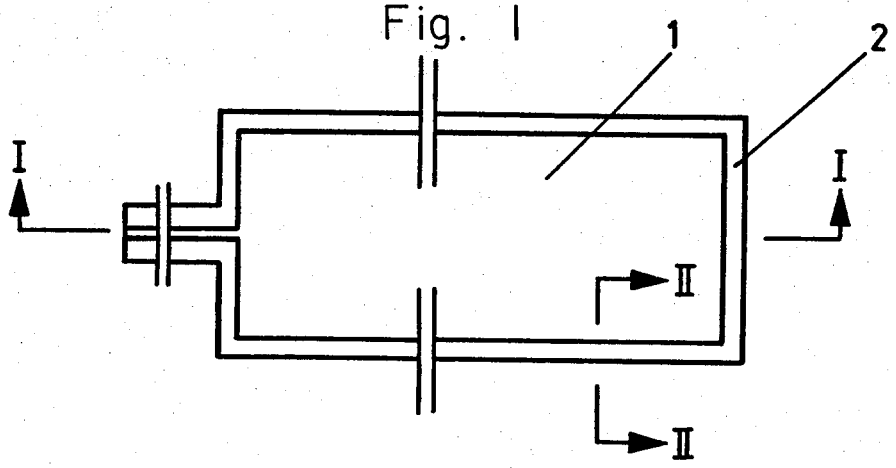

The invention concerns an inductor for an electromagnetic mold for use in continuous casting.

It is well known that, when continuously casting rectangular ingots by the direct chill (DC) method, the surface of the ingot which should be as flat as possible is usually somewhat concave. This concavity appears in particular on the long, flat-sided rolling ingots and depends in part on the format or dimensions, alloy and casting speed. Typical values for the deviation from flatness is 5–10 mm per side for rolling ingots of a 300×1000 mm format in a Mg-containing aluminum alloy cast at a speed of 5–8 cm per minute. This deviation from flatness in the surface is undesirable because it leads to a greater loss of material in scalping, and on rolling makes it difficult to roll the ingot straight.

The characteristic concave shape of the surface of the rolling ingot is due to shrinkage which occurs after the ingot has left the casting mold. While this shrinkage process takes place with geometrical uniformity in the case of round ingots, it is to a large degree unsymmetrical in rectangular ingots. On casting round ingots the thickness of the layer of solidifying metal is very uniform and surrounds a sump of liquid or partially solidified metal which is circular in shape. For this reason the shrinkage stresses tend to compensate one another while the thickness of the shell increases until solidification is complete.

On casting rectangular ingots on the other hand, the cooling is most intensive at the corners of the mold where the metal is subjected to the cooling effect of the mold walls which join up there. The thickness of the layer of solidified metal is therefore not uniform. It is greatest close to the corners of the mold and least at the center of the sidewalls of the mold. If shrinkage occurs, then it takes place most at those places where the solidifying shell is thinnest i.e. at the center of the sidewall faces, and therefore causes the above mentioned deviation from flatness in the large format rolling ingots.

In order to take into account this non-uniform shrinkage and the formation of concave sidewalls, the inner faces of the chill mold are curved outwards. Consequently the ingot leaves the mold with sidewalls which are curved outwards and which then become flat as a result of the shrinkage. Such outward curved molds can be used for ingots which are square or rectangular in cross section; in the case of the latter only the large faces of the mold are usually curved this way (E. Herrmann, Handbuch des Stranggiessens, 1958, p. 134, Canadian Pat. No. 531,090).

The shrinkage process and the concavity due to it on the sidewalls of the ingot occurs in the same manner too when continuously casting in an electromagnetic field. This process is governed by the following electrodynamic relationships: A constant high frequency alternating current is applied to the loop of an inductor which produces a current of known level and known local current density. This current exhibits a magnetic field with a field strength the size of which depends on the size of the current and the distribution of which depends on the distribution of the current density in the conductor. The vertical component $H_y$ of this magnetic field induces an eddy current in the molten metal entering the space during casting. This eddy current flows in the opposite direction to the conductive current in the inductor and its size, current density and distribution depends essentially on the magnitude of $H_y$. From the interaction of $H_y$ and the induced eddy current a ponderomotive force results and is directed towards the center of the melt, its magnitude being proportional to the size of the eddy current and the magnetic field strength $H_y$. This force corresponds to a so-called "electromagnetic pressure". The equilibrium between this and the metallostatic pressure in the melt determines the shape and dimensions of the cast ingot.

Since the shape and dimensions of the ingot cast in the magnetic field, besides these electrodynamic parameters, naturally also depends on the shape of the groundplan of the mold (and thus the inductor) e.g. DT-OS No. 1 508 906, p. 3, it seems obvious that in this process too shrinkage and the consequent sinking-in of the ingot sidewalls should be taken into account by outward curving inductor sidewalls. The production of molds with such curved sidewalls meets however with difficulties in their manufacture, so that such a solution can not be considered satisfactory as a whole.

The objects of the invention presented here was to construct an inductor for an electromagnetic continuous casting mold, which compensates for the shrinkage and allows ingots with flat sidewalls to be cast, and at the same time avoiding the manufacturing difficulties involved in the production of molds with curved sidewalls.

Figure 2A:
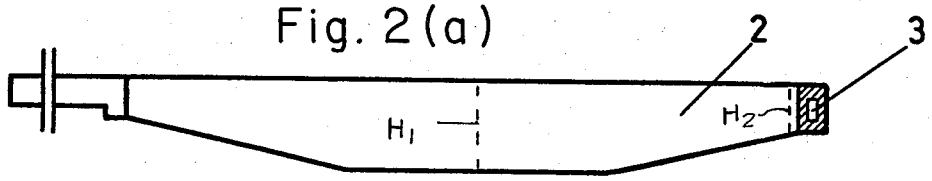
Figure 2B:
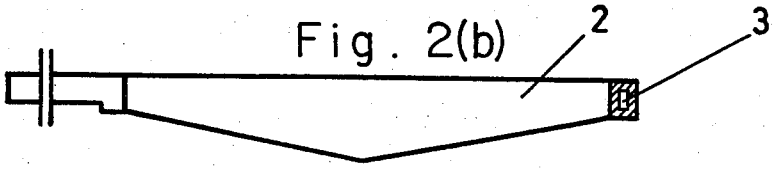
Figure 2C:
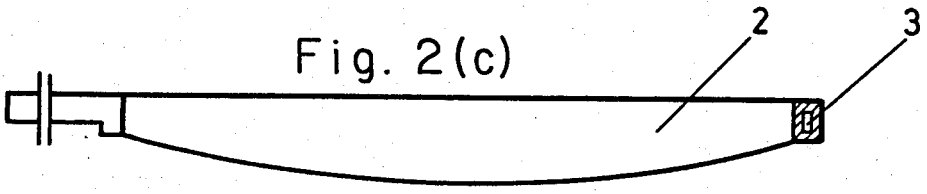
Figure 2D:
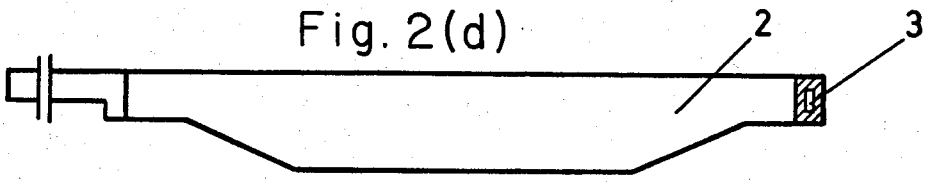
Figure 2E:
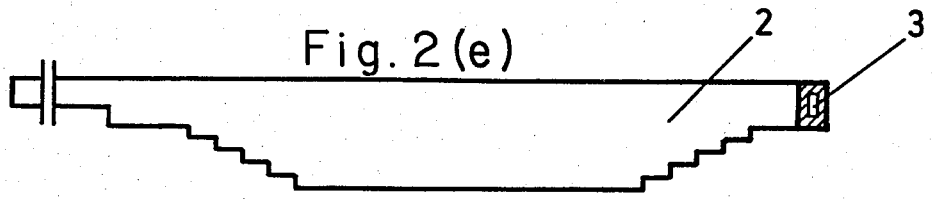

The object is achieved in that the inductor is provided with a metallic loop with a space for the passage of a coolant, the vertical dimension of which in the sidewall middle ($H_1$) is much greater than the vertical dimension ($H_2$) in its corners see FIG. 2*a*.

The invention makes use of the consideration that the shape and dimensions of the melt, when casting in an electromagnetic field (besides the shape of cross section of the inductor used) depends essentially on the vertical component $H_y$ of the magnetic field in the melt. If one looks on the conductive current J flowing in the inductor as the sum of the currents flowing in the linear, elementary conductors, then the magnetic field strength $H_y$ (obtained by addition of the contributions $H_{y,i}$ from the individual, elementary conductors) acting in a given point mass of the melt can be influenced so that the linear, elementary conductors can be influenced in their geometric position i.e. the current density of the conductor as a whole can be influenced.

Since the field strength $H_y$ acting in the point mass determines on the one hand the ponderomotive force in the melt, the electromagnetic pressure in the melt and thus the shape and dimensions of the molten metal, and on the other hand depends in the manner described from the current density in the conductor, it must be possible also to influence the shape of the melt by changing this current density. A correction in the format of the ingot, in terms of a local extension to its dimensions can be achieved this way by locally reducing the current density in the inductor at the desired place. In the same way, a localized reduction can be achieved in the ingot dimensions by increasing the current density at the desired place. The current density can readily be altered in the desired manner by varying the cross section of a metallic loop of high electrical conductivity; from the constructional point of view this is easiest done by varying the vertical dimension of a copper strip of constant thickness. This way the local diminution of the magnetic field $H_y$ and the consequent irregularity of the ingot caused at the filling and join on the loop of an inductor is corrected such that the vertical dimension of the inductor sidewall, which is made of a copper strip, is reduced by cutting back at the place in question, thus raising the current density in the conductor and the magnetic field strength $H_y$ at the place concerned (DT-OS No. 2 060 637 col. 1 line 50 and further, col. 2 line 42 and further, FIGS. 3 and 4).

The invention presented here carries this thinking over to the correction to the concavity in the sidewalls of large format rolling ingots caused by inhomogeneous shrinkage. In this case the aim is to have the melt leaving the mold with slightly convex sidewalls, which are then changed into flat surfaces as a result of the unavoidable shrinkage process. To bring about the convex shape in the sidewalls, the current density in the loop is preferably reduced in the center of the sidewall. For reasons of manufacture this can be done simplest by changing the height of the inductor loop which is in the form of a metal strip of constant thickness.

A number of exemplified embodiments of the invention are illustrated schematically in the following drawings viz., FIG. 1: A plan view of the loop of an inductor.

FIG. 2: Section through FIG. 1 along line I—I showing various kinds of loops.

FIG. 3: Section through FIG. 1 along line II—II showing various kinds of loops.

Figure 3A:
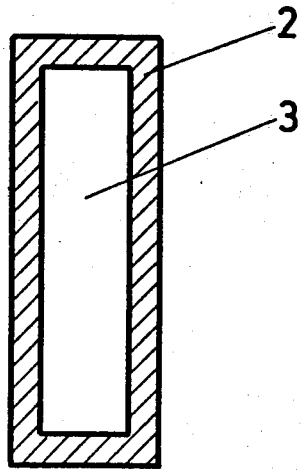
Figure 3B:
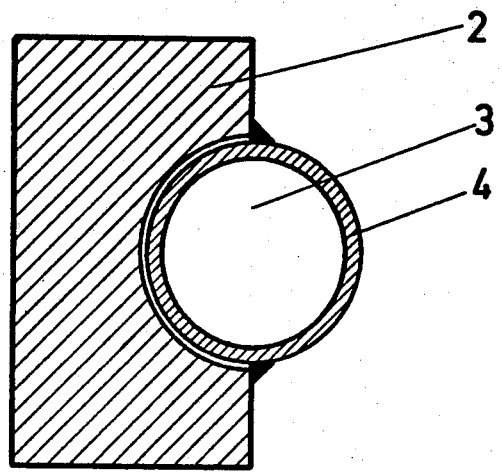

The electromagnetic mold for continuous casting is provided with a housing made of a dielectric material (laminate) which is not shown in the drawings. It has the shape of an elongated, preferably rectangular loop with a space (1) for flat, wide ingots (rolling ingots). The loop of the inductor comprises a water-cooled metallic strip (2), which can have the hollow section shown in FIG. 3 for the passage of cooling water (3). The cooling water pipe can, as shown in FIG. 3*a*, be in the form of a rectangular space in the center of the loop or, as in FIG. 3*b*, as a pipe (4) fixed onto a copper strip. The loop is connected up to an electrical supply system (not shown here) comprising a generator for high frequency alternating current.

The vertical dimension of the loop can, as shown in the version according to FIG. 2, be varied on the side forming the large sidewall of the ingot. For most purposes it is sufficient to have a linear transition from the smaller to the larger vertical distance (FIG. 2*a*), however a five-sided form (FIG. 2*b*), or one in which the lower edge of the loop is an arc of a circle (FIG. 2*c*) also produces satisfactory results; these changes in shape can if necessary first occur at a certain distance from the corners (FIG. 2*d*). All together the part having a vertical dimension $H_2$ should not exceed half of the length of the side-face in question. To facilitate easier manufacture, the transition from the vertical distance $H_1$ to $H_2$ can be made in a series of steps instead of being linear (FIG. 2*e*). In the version shown in FIG. 2*a* the vertical dimension $H_1$ runs preferably up to about one third of the length of an inductor sidewall. In a practical case, for example, the vertical dimension of the loop in the middle was $H_1=60$ mm, at the corners $H_2=50$ mm, however loops with a ratio $R=H_1:H_2=1.05$ to 2.5 can be employed. On casting rolling ingots of format $300\times1050$ mm in a high magnesium-containing aluminum alloy at a casting speed of 8–10 cm per minute, the ratio of $R=1.2$ achieved a compensation for sidewall curvature of up to 5 mm on each side.

What is claimed is:

1. An inductor for an electromagnetic mold for continuous casting of long format rolling metal ingots, said ingots having at least two flat sidewalls running parallel to each other, from molten metal permitting casting of ingots with flat sidewalls which comprises an inductor including at least two substantially flat side walls surrounding said casting having a metallic loop including means for conveying a coolant, said loop having a vertical dimension, wherein the vertical dimension at the middle of the sidewall $H_1$ of the loop is larger than the vertical dimension $H_2$ at its corners, wherein the ratio of $H_1$ to $H_2$ varies from 1.05 to 2.5, said loop including a transition from said vertical dimension $H_1$ to said vertical dimension $H_2$, said inductor compensating for shrinkage which occurs at the sidewall of the ingot and providing ingots which do not suffer from sidewall concavity.

2. An inductor according to claim 1 wherein said transition is achieved by the provision of straight lower faces on the loop, and wherein said vertical dimension $H_1$ is present in at least two places which extend over at least one third of one sidewall.

3. An inductor according to claim 1 wherein said at least two sidewalls of the loop are five-sided.

4. An inductor according to claim 1 wherein said transition is achieved by provision of a lower face of the loop which is arc-shaped.

5. An inductor according to claim 1 wherein said transition is a stepwise transition.

6. An inductor according to claim 1 wherein the loop is rectangular in cross section and has a rectangular hollow space inside it for the passage of cooling water.

7. An inductor according to claim 1 wherein the loop is rectangular in cross section and a cooling water supply line which is circular in cross section is secured to a recess in the loop.

8. An inductor according to claim 1 wherein said ratio is 1.2.

9. An inductor according to claim 1 wherein said transition is achieved by the provision of a series of straight faces in the lower part of the loop.

10. An inductor according to claim 1 wherein said means for conveying a coolant is a hollow space.

* * * * *